US008251878B2

(12) United States Patent
Liu et al.

(10) Patent No.: US 8,251,878 B2
(45) Date of Patent: Aug. 28, 2012

(54) DUMBBELL HAVING ADJUSTABLE INERTIAL RESISTANCE LOAD CHARACTERISTIC

(75) Inventors: Yu Liu, Shanghai (CN); Jianqiang Lu, Shanghai (CN)

(73) Assignee: Shanghai University of Sport, Shanghai (CN)

( * ) Notice: Subject to any disclaimer, the term of this patent is extended or adjusted under 35 U.S.C. 154(b) by 258 days.

(21) Appl. No.: 12/667,041

(22) PCT Filed: Dec. 4, 2009

(86) PCT No.: PCT/CN2009/075311

§ 371 (c)(1), (2), (4) Date: Dec. 28, 2009

(87) PCT Pub. No.: WO2011/066688

PCT Pub. Date: Jun. 9, 2011

(65) Prior Publication Data

US 2011/0190100 A1 Aug. 4, 2011

(51) Int. Cl.
*A63B 21/00* (2006.01)

(52) U.S. Cl. ..... 482/110; 482/91; 482/93

(58) Field of Classification Search ..... 482/100, 482/91, 81, 82, 57

See application file for complete search history.

(56) References Cited

U.S. PATENT DOCUMENTS 3,904,198 A * 9/1975 Jones ..... 482/106
4,513,963 A * 4/1985 Nelson et al. ..... 482/110
6,179,758 B1 * 1/2001 Domenge ..... 482/110
6,488,613 B1 * 12/2002 Domenge ..... 482/110
7,329,212 B2 * 2/2008 Roque ..... 482/110

* cited by examiner

*Primary Examiner* — Jerome W Donnelly

(74) *Attorney, Agent, or Firm* — Global IP Services; Tianhua Gu

(57) ABSTRACT

A dumbbell having adjustable inertial resistance load in the field of athletic sports devices is disclosed. The structure of the present invention is characterized in that the hand grip of the dumbbell is provided inside with a rotatable main shaft, the two swing hammer rods and the swing hammers at both ends of the main shaft constitute a normal pendulum, and the two pendulums at both ends of the main shaft are connected through the main shaft, so as to be functionally combined into the function of one eccentric pendulum. The main shaft, the two swing hammer shafts and the swing hammers constitute an eccentric pendulum. The two pendulums fixed at both ends of the main shaft may be adjusted at different angles. In case the angle between the two pendulums is zero degree, upon the rotation of the pendulums, the forces between the hand grip and the hand, besides the mutual force in the up-and-down direction, also include the periodic inertial force in the fore-and-aft direction. In case the angle between the two pendulums is non-zero degree, upon the rotation of the pendulums, the forces also include the periodic inertial force in the left-and-right direction. By adjusting the weight of the swing hammer, the distance from the swing hammer to the main shaft and the included angle of the two swing hammer rods, the amplitude of the inertial force may be adjusted. This inertial force is a resistance load, and functionally speaking, the dumbbell of the present invention has the characteristic of adjustable inertial resistance load.

6 Claims, 5 Drawing Sheets

DUMBBELL HAVING ADJUSTABLE INERTIAL RESISTANCE LOAD CHARACTERISTIC

FIELD OF THE INVENTION

The present invention relates to the field of athletic sports devices, in particular to an improved dumbbell, the function of which is for enhancing the arm power of one's arm and in the meanwhile training the coordination capability of the whole body muscle.

BACKGROUND OF THE INVENTION

The health consciousness of people nowadays is increasingly improving, they are fond of various fitness sports, and however, many sports are limited by time and space. The sport of dumbbell lifting is one very convenient sport which is beneficial for the health of one's body, as the volume of the dumbbell is small, no excessively large space is necessarily occupied by the user upon lifting the dumbbell, and the sport of dumbbell lifting is not limited by time and space.

The sport of dumbbell lifting is such that the arm of the user upon holding the dumbbell accomplishes the acts of bending and extending of the arm or other general actions, through which the power of the muscle may be trained. However, the sport of dumbbell lifting also has its shortcomings, that is, the sport of dumbbell lifting is mainly for the training of power, while the training on the neuromuscular coordination is insufficient.

The object of the present invention is to add the function of training on the muscular coordination while maintaining the characteristic of the sport of dumbbell lifting that the muscular power is trained under no time or space restriction.

SUMMARY OF THE INVENTION

The present invention aims at providing an inertial dumbbell, which, besides maintaining the training function of existing dumbbells, adds two new functions to the sport of dumbbell lifting by structural improvement: (1) The new structure requires that, upon dumbbell lifting, besides the conventional requirement of power, the action of lifting can only be accomplished by meeting the additional requirement that the power and period for lifting the dumbbell are appropriate, thus the neuromuscular coordination upon dumbbell lifting may be trained. (2) During the process of dumbbell lifting, an additional periodic vibration is generated on the arm and body by the dumbbell, which makes not only the power of arm but also the whole body muscle being trained.

The structure of the present invention is characterized in that the dumbbell is provided inside with a rotatable eccentric pendulum, and upon the user lifting the dumbbell up and down, only when the exerted are appropriate can the eccentric pendulum rotate. The power and strength applied upon lifting the dumbbell without the present structure are not limited, thus the requirement on the neuromuscular coordination during movement is not strong. However, upon lifting the dumbbell of the present invention, requirements are imposed on both the period and the strength of the power exerted. After rotation of the eccentric pendulum within the dumbbell, periodic inertial force is generated, which causes an additional periodic vibration of the arm and the whole body of the user. To be adapted to such a periodic vibration, the whole body muscle is placed under periodic muscular tension, which also provides some training effects for the power of the whole body muscle. This inertial force is a resistance load.

The structure of the present invention is mainly composed of the following parts:

1. Hand grip: or referred to as the dumbbell holding rod, which has a hollow structure interiorly, bearings are mounted within both ends of the hollow tube, and a rotatable main shaft penetrates therein. One protecting disc is fixed at each of both ends of the hand grip.
2. Main shaft: the main shaft penetrates through the interior of the hand grip, and is free to rotate, each of both ends of the main shaft is fixed with a swing hammer shaft, and the swing hammer shafts at both ends may be fixed at mutually parallel positions with respect to each other, and also may be adjusted to be fixed at the positions that form a certain angle with respect to each other.
3. Swing hammer shaft: one end of the swing hammer shaft is fixed on the main shaft by a detachable screw, one or a plurality of swing hammers having a certain weight may be fixed on the swing hammer shaft, the distance from the swing hammer to the main shaft may be arbitrarily adjusted, and scales are provided on the swing hammer shaft indicating the distance from the center of the main shaft. By adjusting the position of the swing hammer on the swing hammer shaft and the number of the swing hammers, the moment of inertial of the pendulum rotating around the hand grip may be adjusted. The swing hammer and the swing hammer shaft should be mutually well fixed, since the centrifugal force of the swing hammer upon the rotation of the pendulum causes the tendency of the swing hammer sliding outwardly along the swing hammer shaft. To avoid the case in which when the swing hammer and the swing hammer shaft are not mutually securely fixed, upon the rotation of the pendulum, the swing hammer may slide and fall off the swing hammer shaft, the other end of the swing hammer shaft is provided with a device for preventing the falling off of the swing hammer.
4. Swing hammer: the swing hammer may be conveniently fixed at different positions on the swing hammer shaft, and the swing hammer is marked thereon with the mass of the swing hammer.
5. Protecting disc: two protecting discs are respectively fixed at both ends of the hand grip, three upright posts are fixed on the periphery of the protecting disc at an equal interval of 120 degrees, and the dumbbell sheet may be arbitrarily added to the three upright posts so as to adjust the weight of the dumbbell. The protecting disc and the three upright posts thereon together with the dumbbell sheet for adjusting the weight of the dumbbell constitute one cylindrical chamber, within which the pendulum may rotate, thus it is ensured that the arm may not collide and scrape against the rotating pendulum, so the function of protecting the arm is provided.
6. Dumbbell sheet: three circular holes are provided on the periphery of the dumbbell sheet at an equal interval of 120 degrees for the mating fixation with the three upright posts on the protecting disc. The number of the dumbbell sheets fixed on the three upright posts may be arbitrarily added, but at least one dumbbell sheet is fixed thereon.

Two swing hammer rods and a plurality of swing hammers constitute two normal pendulums, which are respectively at both ends of the main shaft. The two pendulums at both ends of the main shaft are connected through the main shaft, so as to be functionally combined into the function of one pendulum, and the movement of this combined pendulum has its own characteristic, which we call an eccentric pendulum. The main shaft, the two swing hammer shafts, and the plurality of swing hammers constitute the eccentric pendulum.

The two pendulums fixed at both ends of the main shaft may be fixed at different angles. In case the angle between the two pendulums is fixed at zero degree, upon the rotation of the pendulums, the forces between the hand grip and the hand, besides the periodic mutual force in the up-and-down direction, also include the periodic inertial force in the fore-and-aft direction. In case the angle between the two pendulums is fixed at non-zero degree, upon the rotation of the pendulums, the forces between the hand grip and the hand, besides the periodic inertial forces in the up-and-down direction and in the fore-and-aft direction, also include the periodic inertial force in the left-and-right direction. In case of a normal dumbbell, only mutual force in the up-and-down direction exists between the hand grip thereof and the hand and the mutual force may be non-periodic. The functional feature of the present invention is that, between the hand grip of the dumbbell and the hand, not only the mutual force in the up-and-down direction, but also the inertial forces in the fore-and-aft direction and in the left-and-right direction are present, and the inertial forces are periodic, with a period equal to the rotational period of the eccentric pendulum. The inertial forces in the fore-and-aft direction and in the left-and-right direction are a kind of resistance load.

In the present invention, the mass of the swing hammer, the distance from the swing hammer to the main shaft are adjustable, and the mutual angle of the two swing hammer shafts at both ends of the main shaft is adjustable. Different distances, different masses and different angles between the two swing hammer shafts cause different amplitudes of the inertial forces between the hand grip and the hand generated upon the rotation of the eccentric pendulum in the up-and-down, fore-and-aft and left-and-right directions. The larger the angle between the two swing hammer shafts, the greater the inertial force between the hand grip and the hand in the left-and-right direction. The larger the distance or the larger the mass, the greater the inertial forces between the hand grip of the dumbbell and the hand generated upon the rotation of the pendulum in the up-and-down direction or in the fore-and-aft direction. Thus, functionally speaking, the present dumbbell has the characteristic of adjusting the inertial resistance load.

In case the two swing hammer shafts at both ends are not mounted with any swing hammer, the mutual forces between the hand grip of the dumbbell and the hand in the fore-and-aft direction and in the left-and-right direction are zero, and only the mutual force in the left-and-right direction is present. In a normal dumbbell, only the mutual force in the left-and-right direction is present, thus the present invention also has incorporated the function of the normal dumbbell.

DETAIL DESCRIPTION OF THE INVENTION

Figure 1:
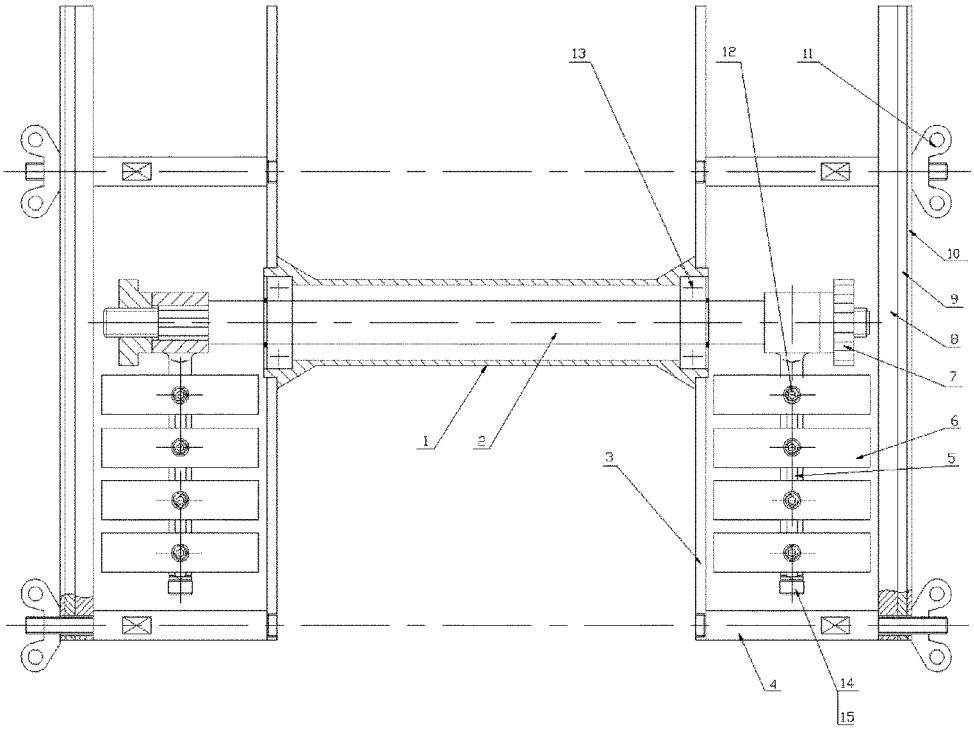
FIG. 1 is an illustrating view showing the assembly of the present invention.

In FIG. 1 which is an illustrating view showing the assembly of the present invention:

1—hand grip;
2—main shaft;
3—protecting disc;
4—upright post;
5—swing hammer rod;
6—swing hammer;
7—nut;
8, 9, 10—dumbbell sheets with different masses;
11—flynut;
12—screw;
13—bearings;
14, 15—screw and gasket.

Figure 2:
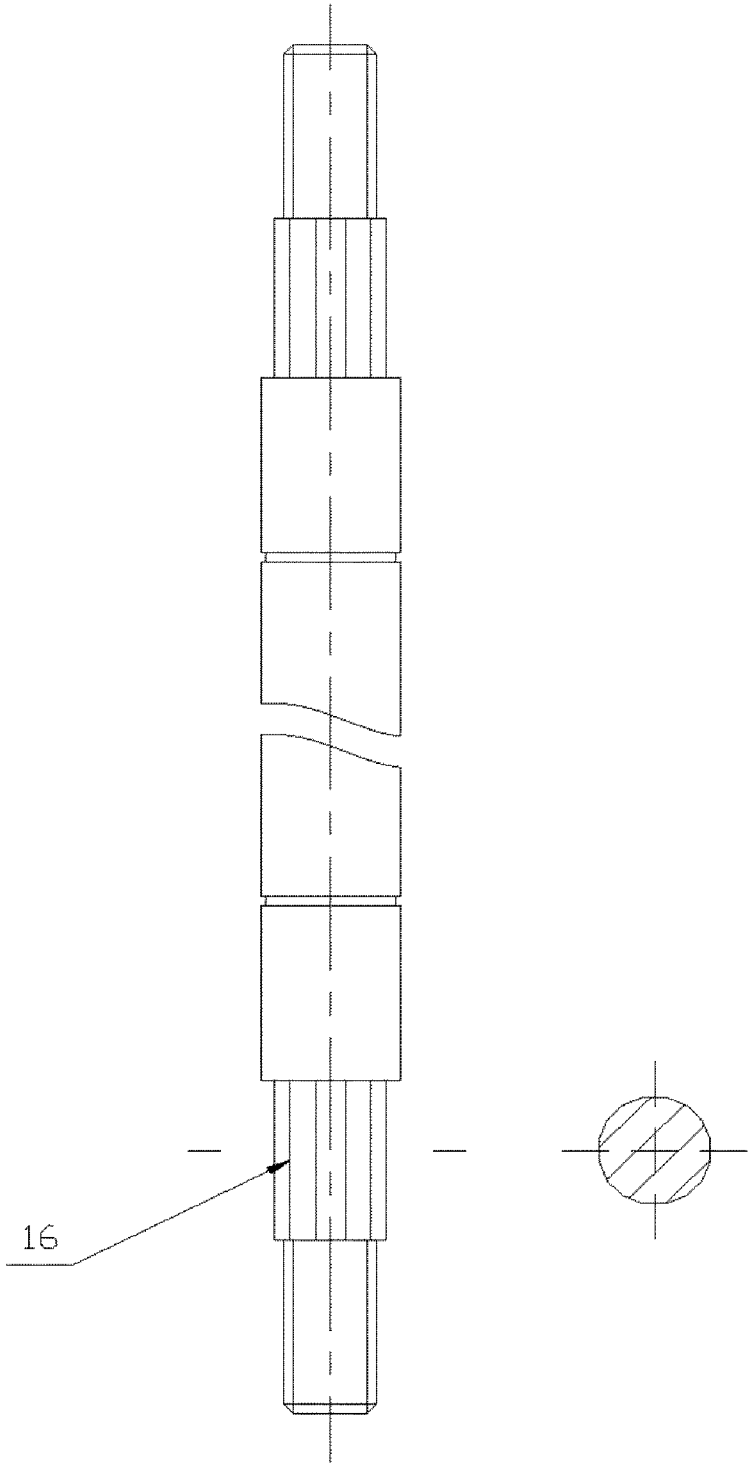
FIG. 2 is an illustrating view showing the pieces of the main shaft in the present invention.
Figure 3:
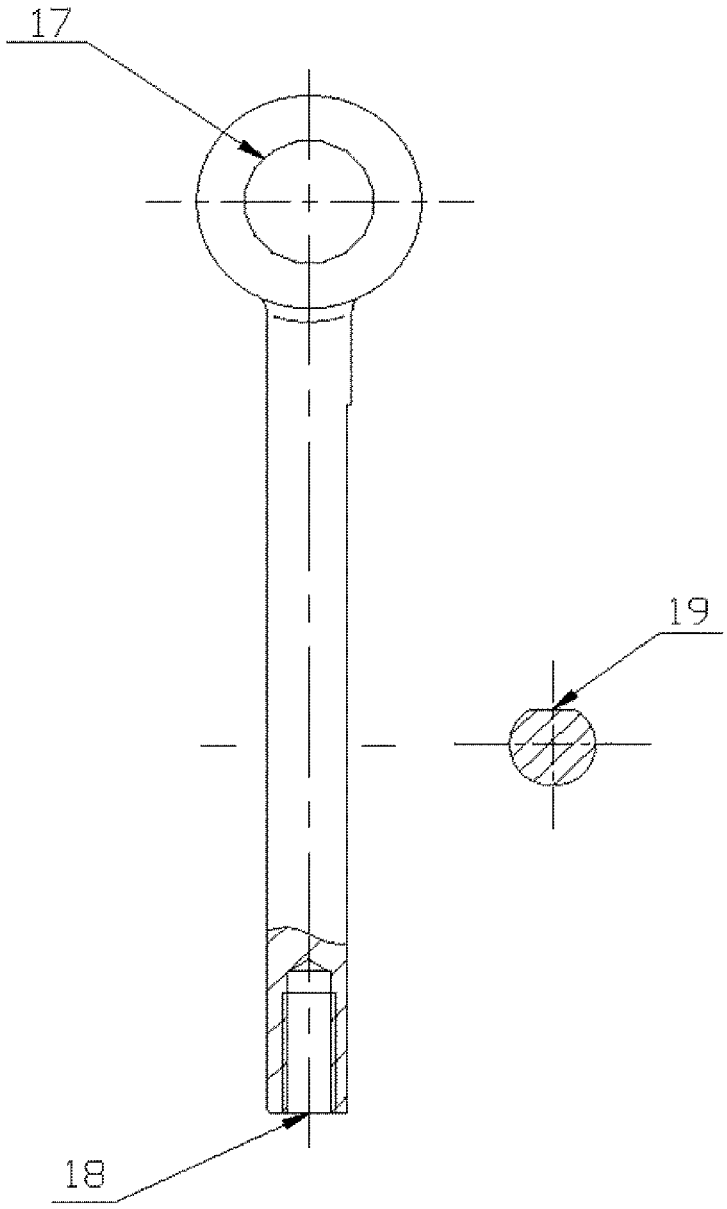
FIG. 3 is an illustrating view showing the pieces of the swing hammer shaft in the present invention.
Figure 4:
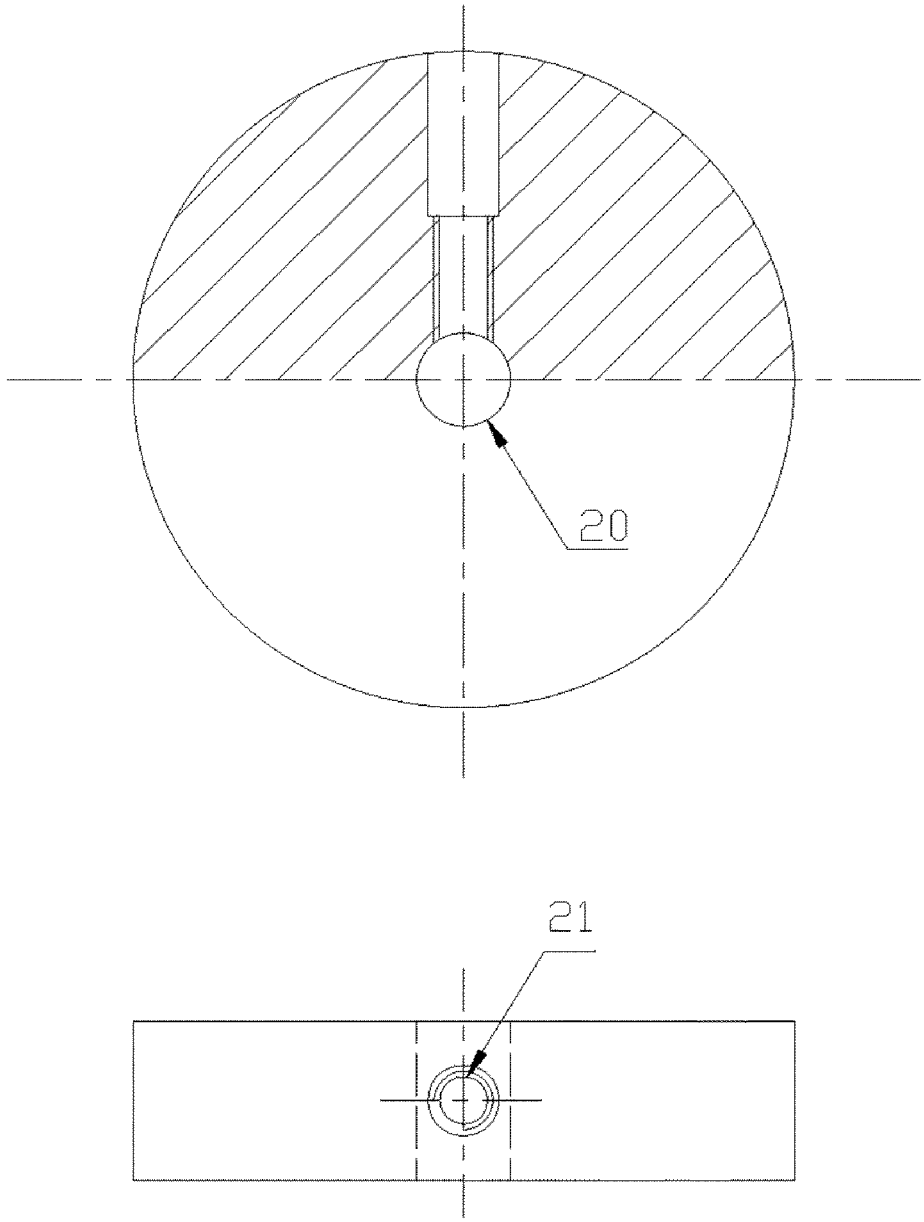
FIG. 4 is an illustrating view showing the pieces of the swing hammer.

Two protecting discs 3 are fixed at both ends of the hand grip 1, three upright posts 4 are fixed on the periphery of the protecting disc 3, and dumbbell sheets 8, 9, and 10 with different weights may be mounted on the three upright posts 4, which dumbbell sheets are fixed with three flynuts 11. The hand grip 1 is a hollow tube, two bearings 13 are mounted at both ends thereof for bearing the main shaft 2. Both ends of the main shaft 2 have a structure of regular dodecahedron (designated as 16 in FIG. 2), which is cooperatively connected with the hole also having a structure of regular dodecahedron (designated as 17 in FIG. 3) at one end of the swing hammer rod 5, thus making the included angle between the two swing hammer rods 5 at both ends of the main shaft 2 adjustable at an integer multiple of 15 degrees, such as 0, 15, 30, 45, 60, 75, 90, 105, 120, 135, 150, 165, 180 degrees and the like. The swing hammer rod 5 is fixed on the main shaft 2 by the nut 7. The swing hammer may penetrate onto the swing hammer rod 5 with a hole (designated as 20 in FIG. 4) in the center of the swing hammer 6. Through the threaded bore (designated as 21 in FIG. 4) in the side surface, the swing hammer 6 may be fixed on the swing hammer rod 5 by a screw 12. The swing hammer rod is marked thereon with distances from the main shaft (designated as 19 in FIG. 3). One or a plurality of swing hammers 6 may be fixed on the swing hammer rod 5 by the screw 12. A M5 threaded bore (designated as 18 in FIG. 3) with a depth of 12 mm may be provided at the other end of the swing hammer rod 5. After the swing hammer 6 is fixed on the swing hammer rod 5, it is fixed on the threaded bore with the screw and the gasket 14 and 15 to prevent the sliding off of the swing hammer 6.

Figure 5:
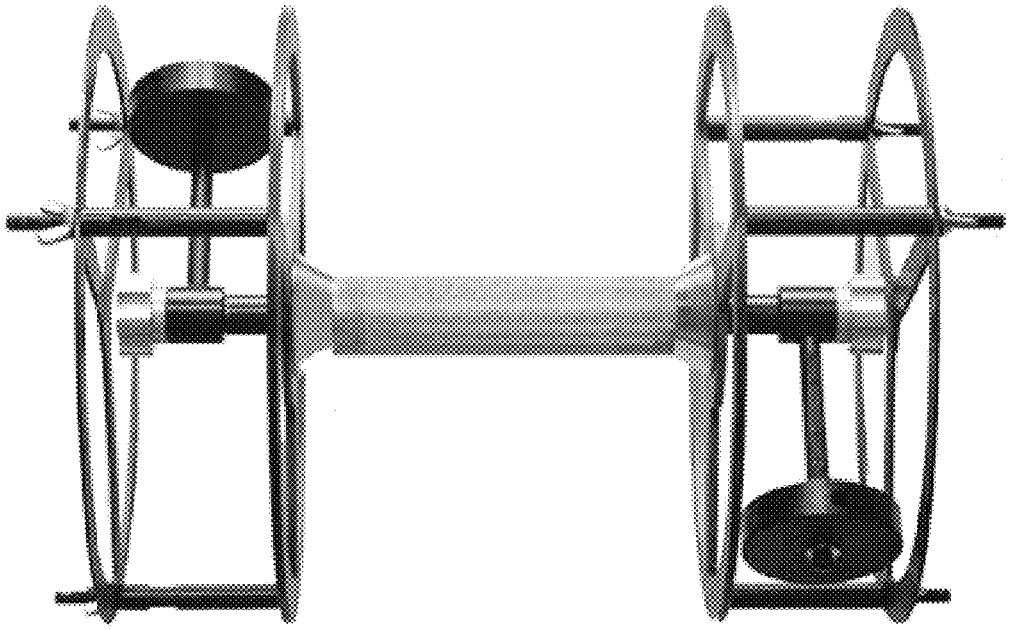
FIG. 5 is a photograph of an embodiment of the present invention.

FIG. 5 is a photograph of an embodiment of the present invention.

In the state of the present embodiment as shown in the photograph, one swing hammer is respectively fixed on the swing hammer rod at both ends, the weight of the swing hammer is 0.25 kg, the distance from the center of the swing hammer to the center of the main shaft is 8.5 cm, and the included angle between the two swing hammer rods is 180 degrees. One dumbbell sheet is added at both ends, and the total weight thereof is 2.7 kg.

In the present embodiment, 4 swing hammers weighing 0.25 kg may be respectively fixed on each of the two swing hammer rods. The dumbbell sheet for adding the weight in the present embodiment may have three types, that is, 2 kg, 1 kg, and 0.5 kg. Different combinations of the counterweight in the present embodiment may allow the weight of the dumbbell to be adjusted between 2.7 kg and 11 kg.

It is found in practical application of the present embodiment that, as compared with the normal dumbbell of the same weight, the lifting of the normal dumbbell does not require the process of learning, which may be directly lifted up. However, the lifting of the dumbbell of the present embodiment requires a brief process of learning. In the lifting of the normal dumbbell, what is involved is mainly the movement of the arm, the fore-and-aft swinging of the chest and the abdomen is not obvious, and the up-and-down movement of the chest and the abdomen is almost absent. In the lifting of the dumbbell of the present embodiment, the whole body movement is involved, the fore-and-aft swinging as well as the up-and-down movement of the chest and the abdomen is present, and there is also a small amount of change in the knee joint, which demonstrates that the lifting of the dumbbell of the present embodiment requires a coordinated movement of the whole body.

The above described embodiment is merely for the purpose of explaining the present invention. All variations, modifications and applications made by those skilled in the art within the scope of the spirit of the present invention are intended to be covered by the present invention.

What is claimed is:

1. An inertial dumbbell comprising:

a hand grip having a hollow tube structure;

an eccentric pendulum having:

a main shaft being mounted within the hollow tube structure and supported by two bearings, thereby the main shaft can spin in the bearings, two swing hammer rods being connected with the main shaft at two ends respectively, and a plurality of swing hammers being fixed on the two swing hammer rods respectively;

two protecting discs being fixed at both ends of the hand grip, three upright posts being fixed on periphery of the protecting disc, a plurality of dumbbell sheets being mounted on the three upright posts;

the protecting discs, the three upright posts, and the dumbbell sheets enclose and constitute a space, the swing hammer rod and the swing hammer is able to rotate within this space.

2. The inertial dumbbell as claimed in claim 1, wherein both ends of the main shaft have a structure of regular dodecahedron, which is cooperatively connected with a hole also having a structure of regular dodecahedron at one end of the swing hammer rod, thus making an included angle between the two swing hammer rods at both ends of the main shaft adjustable.

3. The inertial dumbbell as claimed in claim 1, wherein at least one of swing hammers can be fixed on the swing hammer rod at different distances from the center of the main shaft so as to adjust the moment of inertial of the swing hammer rotating around the hand grip.

4. The inertial dumbbell as claimed in claim 1, wherein an end of the swing hammer rod not connected with the main shaft is provided with a device for preventing the swing hammer from sliding off the swing hammer rod.

5. The inertial dumbbell as claimed in claim 1, wherein a plurality of dumbbell sheets with different masses can be mounted on the three upright posts so as to adjust the total weight of the dumbbell.

6. The inertial dumbbell as claimed in claim 3, wherein an end of the swing hammer rod not connected with the main shaft is provided with a device for preventing the swing hammer from sliding off the swing hammer rod.

* * * * *